US005400955A

United States Patent [19]

Coalier et al.

[11] Patent Number: 5,400,955

[45] Date of Patent: Mar. 28, 1995

[54] BOX FORMED FROM A SHEET MATERIAL, BLANK

[75] Inventors: Guy Coalier, Noce; Jean-Yves Bacques, Paris, both of France

[73] Assignee: Otor, Paris, France

[21] Appl. No.: 14,453

[22] Filed: Feb. 5, 1993

[51] Int. Cl.[6] ..... B65D 5/42; B65D 5/46

[52] U.S. Cl. ..... 229/108; 229/109; 229/116; 229/117.13; 229/103.3

[58] Field of Search ..... 229/40, 101, 113, 117.12, 229/117.13, 116, 108, 109; 206/427

[56] References Cited

U.S. PATENT DOCUMENTS

| | | | |
|---|---|---|---|
| 1,795,672 | 3/1931 | Plummer | 229/116 |
| 2,001,177 | 5/1935 | Bodor . | |
| 2,345,646 | 4/1944 | Williamson | 229/113 |
| 2,572,610 | 10/1951 | Gilbert . | |
| 2,643,815 | 6/1953 | Komeo . | |
| 3,403,839 | 10/1959 | Farquhar | 229/40 |
| 3,688,972 | 9/1972 | Mahon | 229/40 |
| 3,986,658 | 10/1976 | Arneson et al. | 229/40 |
| 4,242,949 | 1/1981 | Auckenthaler . | |
| 4,308,023 | 12/1981 | Bidegain . | |
| 4,932,930 | 6/1990 | Coalier et al. . | |
| 5,147,271 | 9/1992 | Bacques et al. . | |
| 5,160,307 | 11/1992 | Bacques et al. . | |
| 5,264,996 | 11/1993 | Bole, Jr. et al. | 229/113 |

FOREIGN PATENT DOCUMENTS

| | | | |
|---|---|---|---|
| 1216303 | 11/1959 | France . | |
| 2508415 | 12/1982 | France | 206/427 |
| 3541821 | 4/1987 | Germany . | |
| 820050 | 9/1959 | United Kingdom . | |
| 2236095 | 3/1991 | United Kingdom | 229/116 |

*Primary Examiner*—Gary E. Elkins
*Attorney, Agent, or Firm*—Larson and Taylor

[57] ABSTRACT

Box of sheet material, such as cardboard or corrugated cardboard, including square or rectangular lateral faces, in pairs, connected by a folding line. The folding lines are mutually parallel and the lateral faces forming a right-angled parallelepiped (pa). This box includes other lateral faces forming a pyramid (py) adjoined by its base to the parallelepiped. It is obtained from a blank of sheet material including triangular or trapezoidal panels hinged to rectangular or square panels.

25 Claims, 9 Drawing Sheets

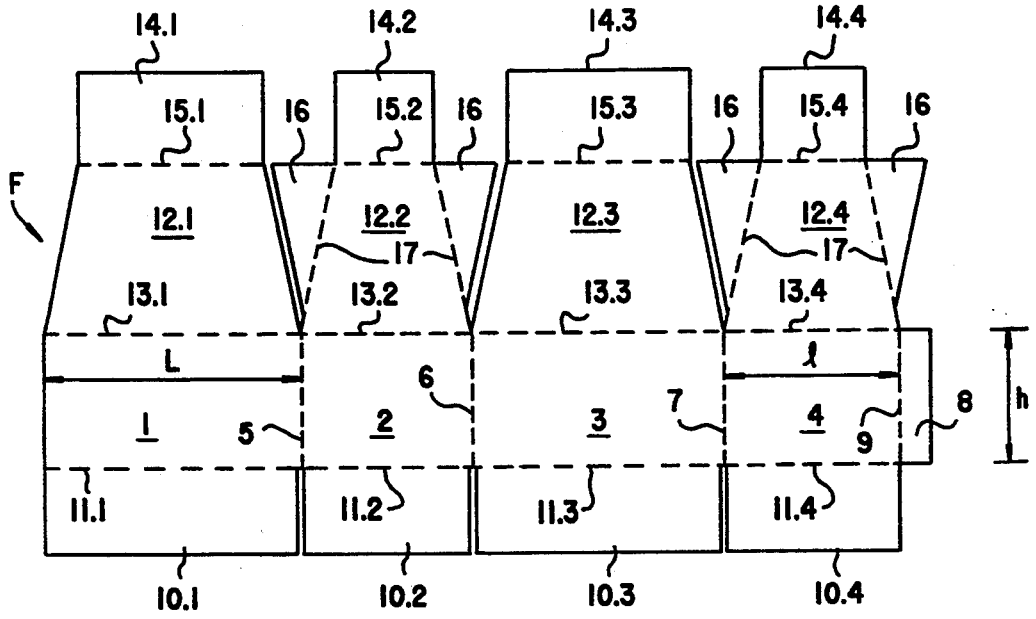
FIG.1
FIG.2
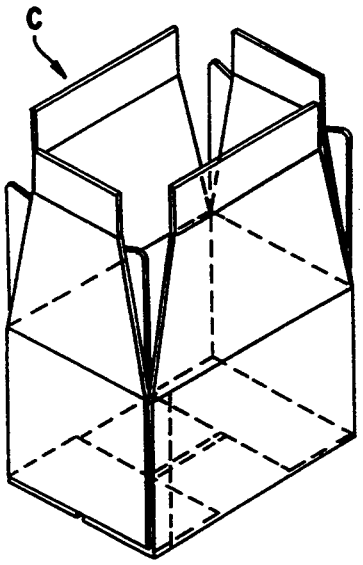
FIG.3
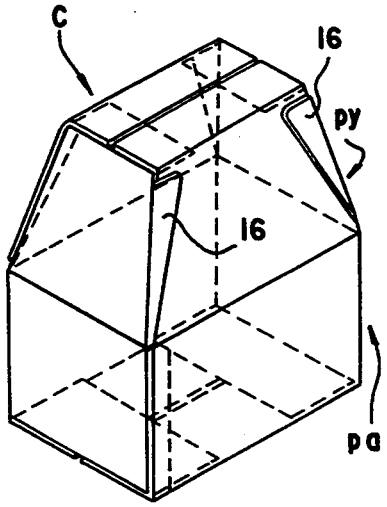

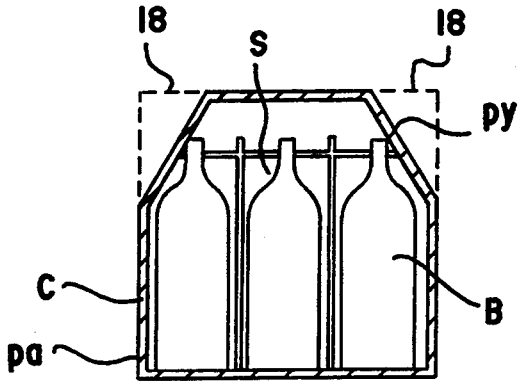
FIG.4
FIG.5
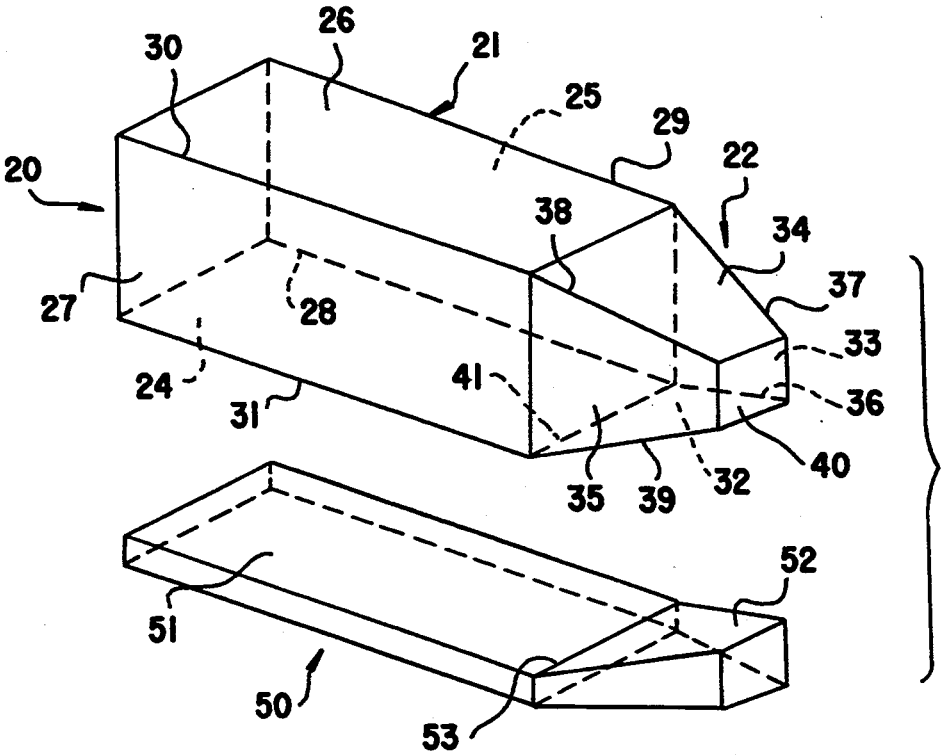

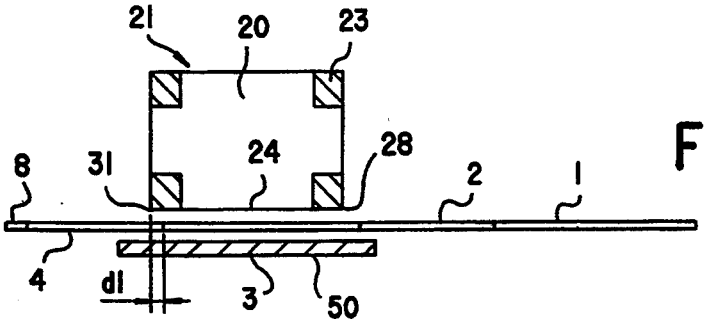
FIG.6a
FIG.7a
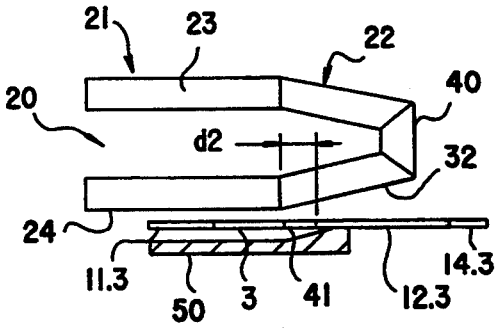
FIG.6b
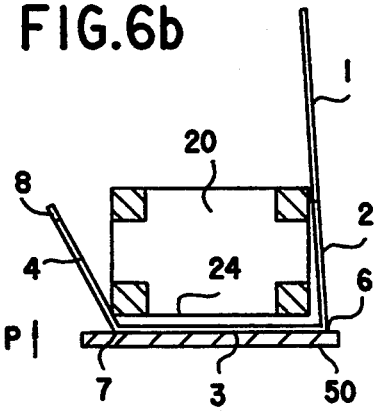
FIG.7b
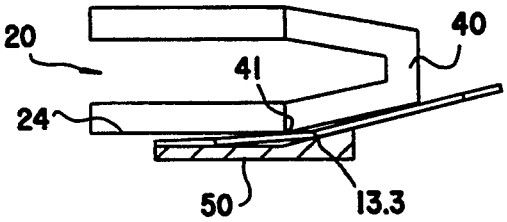
FIG.6c
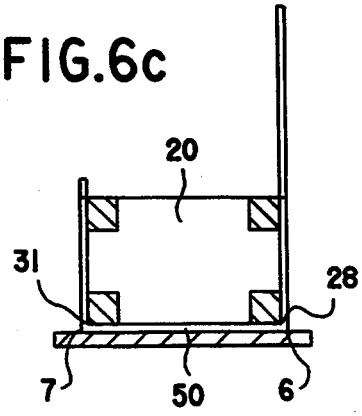
FIG.7c
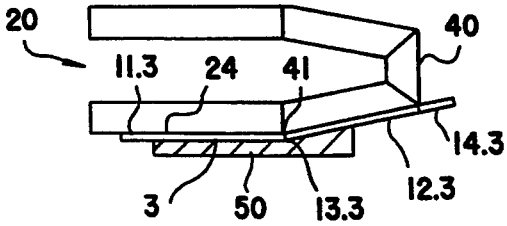

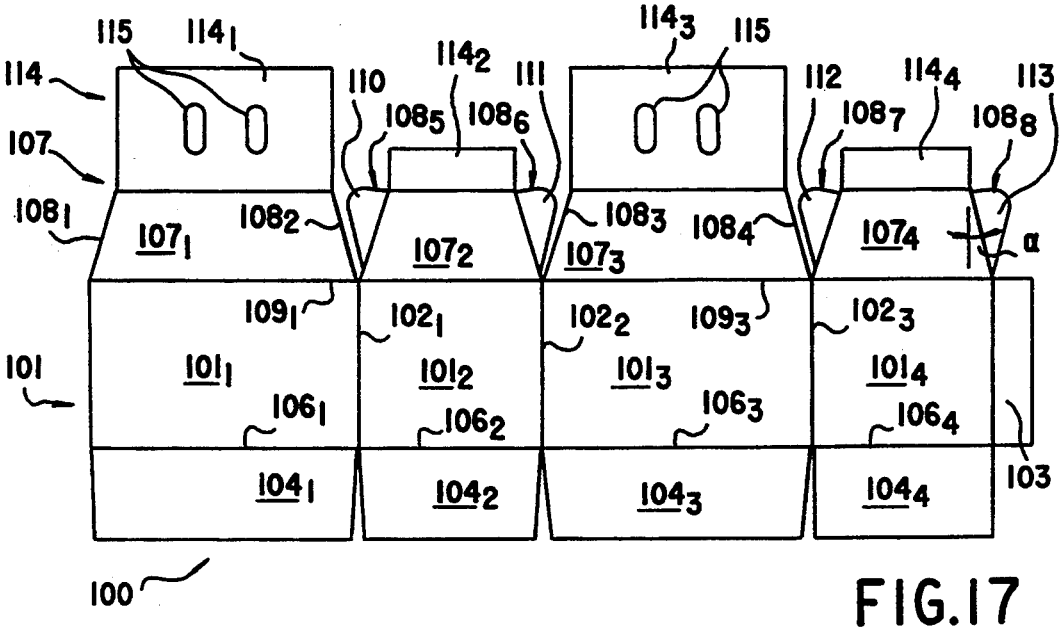
FIG.17
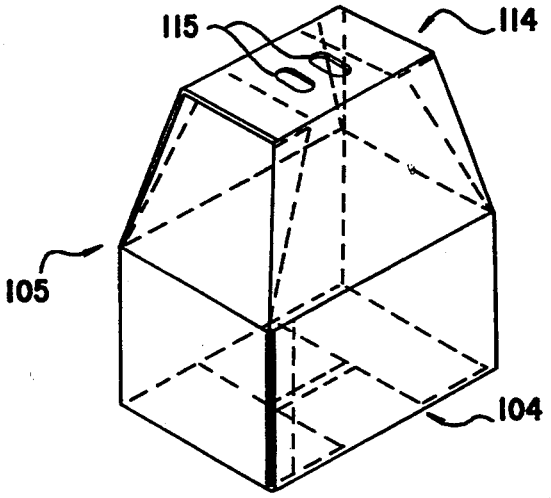
FIG.19
FIG.21
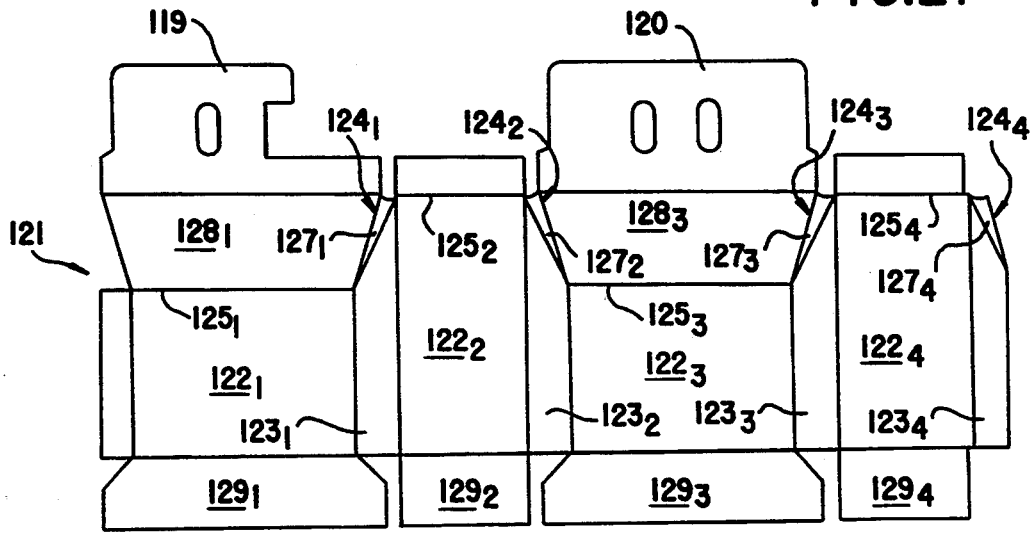

BOX FORMED FROM A SHEET MATERIAL, BLANK

The present invention relates to boxes made of cardboard, corrugated cardboard or similar sheet material, as well as the blanks of such material for the production of said boxes and a method for producing said boxes from said blanks.

Machines and methods by virtue of which it is possible to produce a cardboard box or the like by wrapping a blank around a mandrel are known, for example from Patent FR-A-2,629,012 (or U.S. Pat. No. 4,932,930). In these machines, said mandrel is essentially a right-angled parallelepipedal, so that the boxes obtained are also right-angled parallelepipedal.

Such boxes are used for packaging articles or groups of articles which are inserted therein via the lid which remains open, the lid only being closed after insertion of said articles.

The cross section of the load constituted by said articles or groups of articles is rarely, if indeed ever, constant over the entire height of said load and at best adapts, along the height of the box into which said load is inserted, to the shape of said box, so that at least some corners projecting from the said box are empty. As a result these empty projecting corners of the box, which are exposed to external attack, can easily be torn, which impairs the presentation and protection of the packaged articles. In addition, the empty corners of the box constitute a waste of sheet material, since they are unnecessary.

The object of the present invention is to remedy these drawbacks.

With this aim in mind, the present invention provides especially a box of sheet material, such as cardboard or corrugated cardboard, including square or rectangular lateral faces, in pairs, connected by a folding line, said folding lines being mutually parallel and said lateral faces forming a right-angled or substantially right-angled parallelepiped, for example a parallelepiped having cut corners. The box also includes other lateral faces forming a pyramid or a pyramid portion adjoined by its base to said parallelepiped, each of said other lateral faces being formed by a panel having free edges.

By edges of a panel is meant the lateral peripheral parts of the panel.

Thus, by virtue of the parallelepipedo-pyramidal or substantially parallelepipedo-pyramidal shape of the box in accordance with the present invention:

- it is possible best to match the shape of the box to that of the load which it is to contain;
- it is possible to eliminate the empty and unnecessary projecting corners of the box, which enables, on the one hand, the risks of deterioration of said projecting corners to be reduced and, on the other hand, savings of sheet material to be made.

It will be noted that U.S. Pat. No. 2,643,815 relates to a case, intended to contain loose products, including trapezoidal panels connected to each other by triangular gussets intended to form the seal between the trapezoidal panels when the loose product is poured out of the case by using the pouring spout constituted by the pyramidal part of the case.

The object of U.S. Pat. No. 2,643,815 is therefore not, as is the case in the present invention, to match the shape of the articles contained but, on the contrary, to serve as a pouring spout.

Moreover, the sealing gussets, forming an integral part of the panels, require, while being formed into the box, a specific folding incompatible with techniques for industrial production of boxes.

In the preferred embodiment of the invention, the box includes lateral tabs along at least one part of the lateral intersecting edges of at least one part of the faces of said pyramid, whether these are formed by the bands of the upper lateral faces or by the upper edges of the cut corners of the box constituting lower lateral faces, as will be seen in more detail below.

The tabs are advantageously in the form of a substantially triangular lug, for example in the form of an isosceles triangle of apex directed downwards, which tabs can be folded over inward and are connected to the panel forming a corresponding upper lateral face by a folding line.

Said other lateral faces can be triangular. However, advantageously, they are given a trapezoidal shape. Thus, it is possible to provide, for said box, a closure face truncating said pyramid on the side opposite said parallelepiped.

Also advantageously, in the case of a box having cut corners, two lateral faces, for example the widest ones, are given an inverted trapezoidal shape, the other faces of the upper part of the box being vertical, thus forming faces in a single plane, from bottom to top of the box, without folds.

According to another aspect of the invention, a blank of sheet material, such as cardboard or corrugated cardboard, is provided which is intended for the production of the box in accordance with the present invention and including a series of rectangular or square first panels connected to each other by first folding lines which are parallel to each other and a first set of lateral flaps arranged on one side of said series of panels, which flaps are connected to the latter by folding lines perpendicular to said first folding lines and are intended to form, at least partially, the bottom of said box.

The blank includes triangular or trapezoidal second panels, each of which panels is connected, by its base and on the side opposite the lateral flaps of said first sets to one of said first panels along a third folding line perpendicular to the said first folding lines.

Preferably, said second panels being trapezoidal, the blank includes a second set of lateral flaps arranged on the side of the small base of said second panels, which flaps are connected to the latter by fourth folding lines perpendicular to said first folding lines and are intended to form, at least partially, a closure face for said box.

Advantageously, this concerns the upper face, the facing flaps covering the entire or virtually the entire upper horizontal face of the box.

Gripping holes for fingers are then advantageously provided in this upper face which is also reinforced by the small lateral flaps glued on the underside.

The present invention also provides a blank for a box of cardboard or corrugated-cardboard sheet material, including:

- a set of square or rectangular first panels connected by first mutually parallel folding lines, said first panels being suitable for forming the lower part of the parallelepiped-shaped or substantially parallelepiped-shaped box,
- four lower flaps respectively connected, at the bottom part of four of said first panels, by second folding lines perpendicular to said first folding lines, said lower flaps being suitable for forming the bottom of said box, a set of second panels connected to at least one part of said first panels, at the top part of the latter, by third folding lines perpendicular to said first folding lines, said second panels being suitable for forming with each other, or with the upper parts of the first panels not including second panels at the top part, a truncated pyramid connected by a base to said parallelepiped at the top part of the latter, in order to form the upper part of the box, said second panels, or said second panels and said upper parts of said first panels, having free lateral edges between them, four upper flaps respectively connected, at the top part of each of said second panels, or of said second panels and of said upper parts of said first panels, by fourth folding lines perpendicular to said first lines, namely two small upper flaps and two large upper flaps, said large upper flaps each having a surface area of a size equal to the upper closure face of said box, the first flaps, the first panels and at least one part of the second panels being constructed for being wrapped or folded around a mandrel of shape complementary to the box by folding over around said mandrel.

Advantageously, all the panels are constructed for being folded around the mandrel.

Advantageously, one free lateral edge in two comprises a substantially triangular flap which can be folded over and is connected to the central part of the panel by a folding line.

The triangle is, for example, an isosceles triangle and has a base in the form of a flattened circular arc extending outward, for example over 2 or 3

Advantageously too, the blank comprises four second panels and four tabs which can be folded over, the tabs which can be folded over being respectively integral with the two symmetrical lateral edges of two non-adjacent second flaps.

In advantageous embodiments one and/or the other of the following arrangements are also available:

the external edge of the tab which can be folded over is separated by a defined distance from the tab-free external edge of the adjacent panel;

the defined distance lies between of the order of 3 mm and of the order of 3 cm;

the tabs which can be folded over are respectively integral with the two lateral edges of two non-adjacent second panels, a distance of defined length lying between 3 mm and 1 cm existing between the third folding line, separating the second panel equipped with a tab from the first panel to which it is attached, and the apex of the substantially isosceles triangle formed by the said corresponding triangular tab;

the tabs which can be folded over are each respectively integral with one edge of the upper parts of four first panels;

the blank permits making up a box having cut corners; in order to do this the set of first panels comprises four panels making up the principal lateral walls of the body of the box and four panels making up the intermediate lateral walls for forming said cut corners, the tabs which can be folded over being integral with the edges of the upper parts of the four first panels constituting the intermediate lateral walls forming the cut corners, said edges respectively connecting, for each cut corner, the third folding line and the fourth folding line of the two first panels adjacent to said intermediate lateral wall forming a cut corner;

two gripping orifices on each large upper flap are provided;

the heights of the small upper flaps and of the large upper flaps enable two blanks, the upper edges of the upper flaps of which blanks are in contact, to be simultaneously presented, head to tail and symmetrically with respect to a point;

two of the second panels include lateral edges having a folding intersecting edge inclined inward from the third folding lines and are interspersed with two other second panels having lateral edges inclined outward from the third folding lines, the second panels including lateral edges having a folding intersecting edge inclined inward including the tabs which can be folded over, folding inward, of said flaps in order to be reformed inside the adjacent second panels and thus to form the upper part of the pyramid-shaped box.

The invention also provides a box of cardboard sheet material produced from a blank as defined hereinabove.

A machine is described in French Patent FR-A-2,629,012 for the production of a box from a blank of material or sheet including a series of rectangular or square first panels connected to each other by first folding lines parallel to each other and a first set of lateral flaps arranged on one side of said series of panels, which are connected to the latter by second folding lines perpendicular to said first folding lines and are intended to form, at least partially, the bottom of said box, said machine comprising:

a mandrel, the outer cross section of which corresponds to the inner cross section of said box to be obtained;

means for freely supporting an intermediate panel of said series of panels, at least approximately, opposite the corresponding face of said mandrel, but at some distance from the latter, then for moving said intermediate panel toward said corresponding face of the mandrel and then for pressing said intermediate panel against said corresponding face, after folding the panels adjacent to said intermediate panel until said adjacent panels bear against said mandrel;

means for wrapping said series of first panels around said mandrel; and means for fixing together the outermost panels of said series of first panels thus wrapped on said mandrel.

Such a machine makes it possible to remedy the drawbacks inherent in those provided for the production of the American boxes. It is therefore advantageous to perfect such a machine for the manufacture of the boxes according to the invention.

For this purpose, according to another aspect of the present invention, the machine of the type recalled hereinabove is noteworthy in that, said blank including triangular or trapezoidal second panels, each of which panels is connected, by its base and on the side opposite the lateral flaps of said first set, to one of said first panels along a third folding line perpendicular to said first folding lines:

said mandrel has the shape of a parallelepiped to which a pyramid is adjoined by its base;

said means for supporting, for moving closer and for pressing said intermediate panel include a pressure plate comprising two faces rigidly linked together, the first of said faces corresponding to said intermediate panel and the second to that one of said second panels which is adjacent to said intermediate panel, said first and second faces of the pressure plate determining a dihedron such that, when said first face is applied against the corresponding face of the parallelepipedal part of the mandrel, said second face is applied against a face of the pyramidal part of said mandrel corresponding to said adjacent second panel, the intersecting edge of said dihedron then being in coincidence with that intersecting edge of said mandrel which is determined by said faces of said mandrel corresponding respectively to said parallelepipedal part and to said pyramidal part;

means are provided for applying said second panels against a corresponding face of the pyramidal part of said mandrel; and means are provided for fixing together said second panels thus applied against said mandrel.

Thus, a first panel and a second panel of said blank are perfectly positioned with respect to the mandrel and are held with respect to the corresponding faces of the latter during the wrapping of said blank, so that the box obtained has a particularly precise shape.

In the case where at least some of said second panels comprise, along at least one of their inclined edges, a triangular tab which can be folded over and is connected to said second corresponding panel by a folding line, it is advantageous for said means for fixing together said second panels to include means for folding over said triangular tabs and for fixing them to the second panels which are adjacent to those which bear them.

Moreover, for a blank in which said second panels are trapezoidal and which includes a second set of lateral flaps arranged on the side of the small base of said second panels, which are connected to the latter by fourth folding lines perpendicular to said first folding lines and are intended to form, at least partially, a closure face for said box, the machine in accordance with the invention includes:

means for folding the flaps of said second set against the end face of the pyramidal part of said mandrel; and means for fixing together said flaps thus folded.

Advantageously, said means for wrapping said series of first panels around the mandrel include movable equipment comprising swing arms.

The figures of the attached drawing will make it well understood how the invention can be produced. In these figures, identical references designate similar elements.

FIG. 1 shows, flat, a blank of sheet material for the manufacture of one embodiment of a box in accordance with the present invention.

FIGS. 2 and 3 show, in perspective, the box obtained from the blank of FIG. 1, said box being respectively shown open (FIG. 2) and closed (FIG. 3).

FIG. 4 illustrates, in vertical section, a use of the box of FIGS. 2 and 3.

FIG. 5 shows, in perspective, a mandrel and a pressure plate for the production of the box according to the invention.

FIGS. *6a, 6b, 6c* and *7a, 7b, 7c* illustrate diagrammatically the procedure for forming the box of the invention from the blank of FIG. 1, FIGS. *6a, 6b* and *6c* corresponding to transverse sections of the parallelepipedal part of the mandrel and FIGS. *7a, 7b* and *7c* to longitudinal sections of said mandrel.

Figure 8:
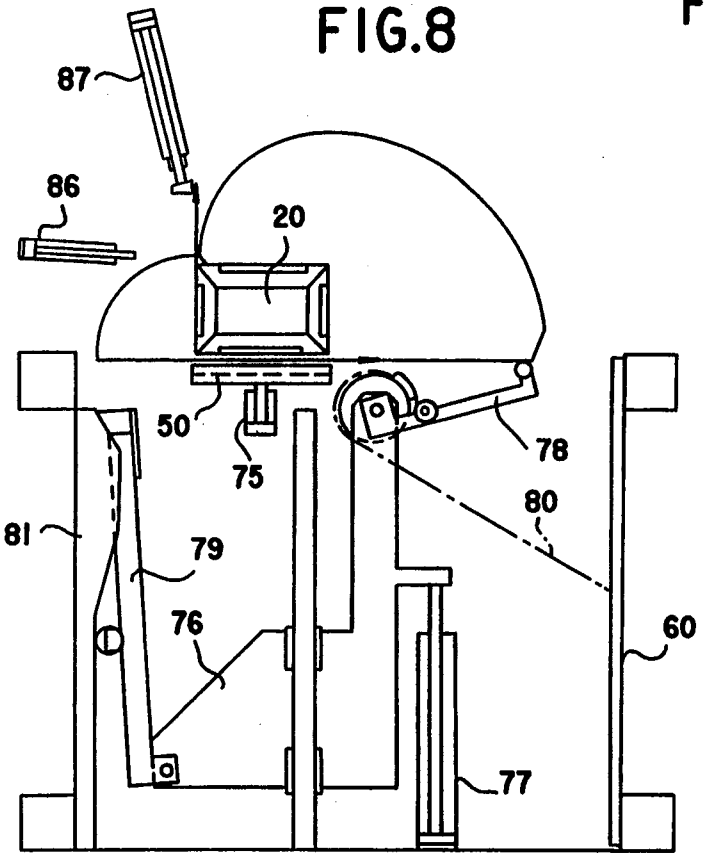
Figure 11:
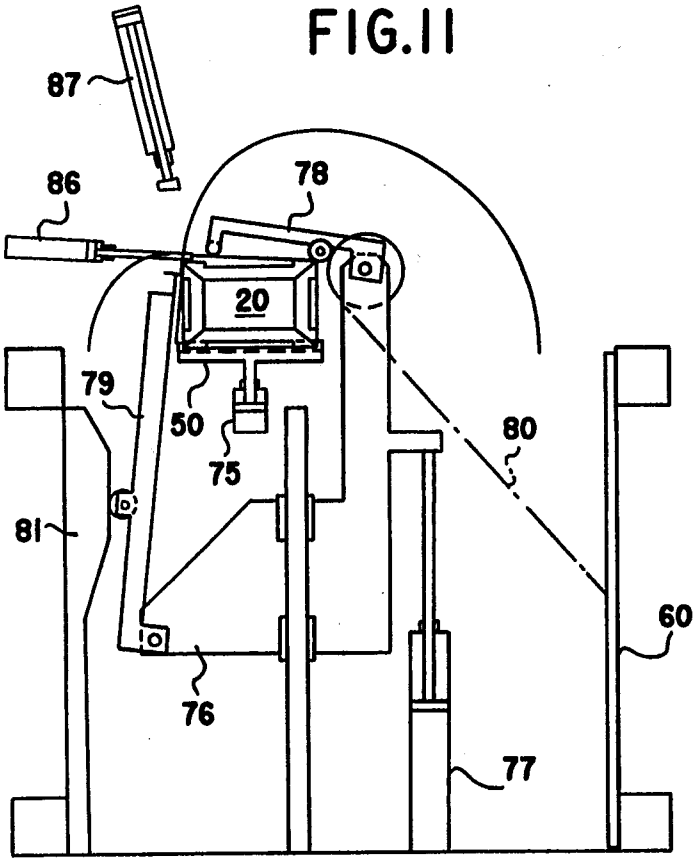
Figure 14:
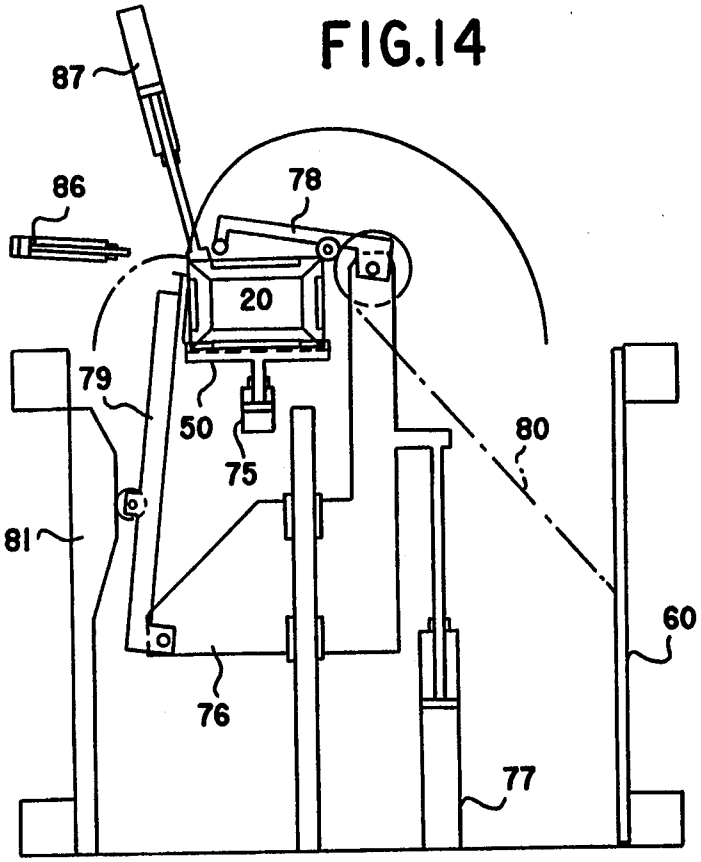

FIGS. 8, 11 and 14 are diagrammatic views, in elevation, of a machine intended for the manufacture of the box of the invention, from the blank of FIG. 1, at various stages of this manufacture.

Figure 9:
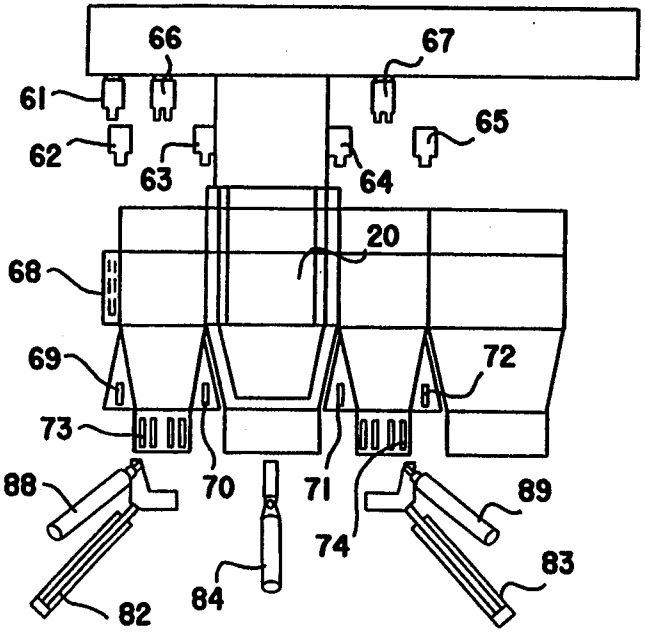
Figure 12:
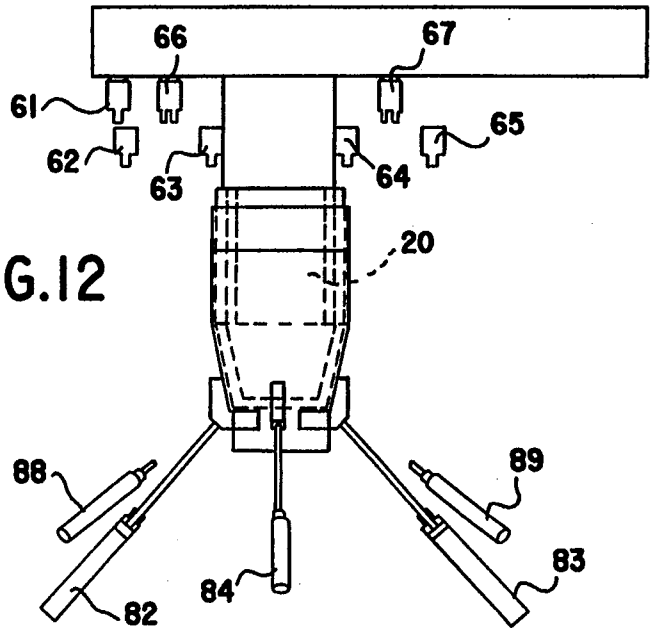
Figure 15:
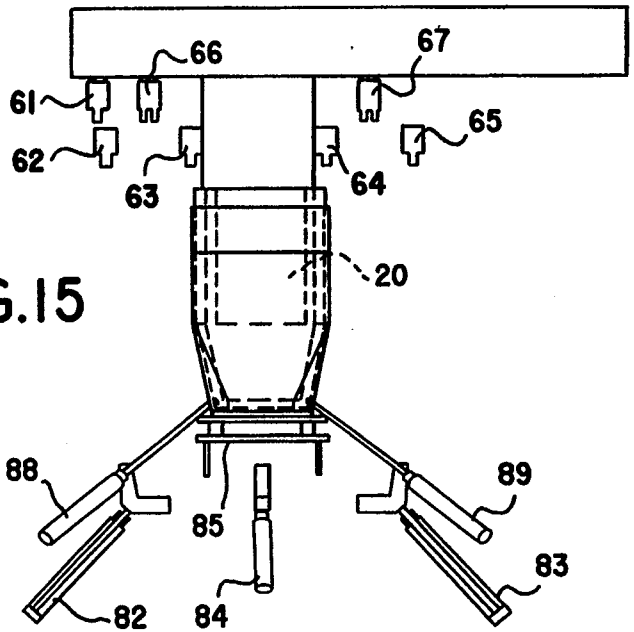

FIGS. 9, 12 and 15 are diagrammatic plan views corresponding respectively to FIGS. 8, 11 and 14.

Figure 10:
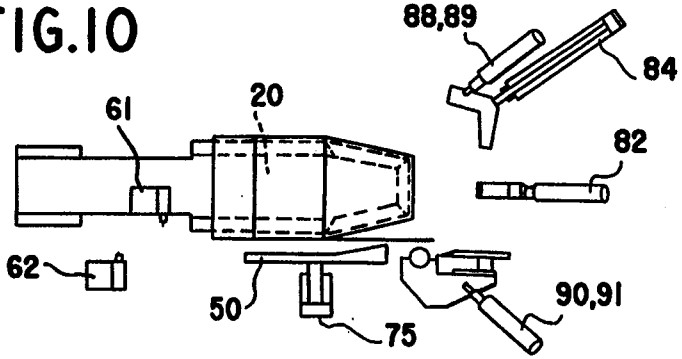
Figure 13:
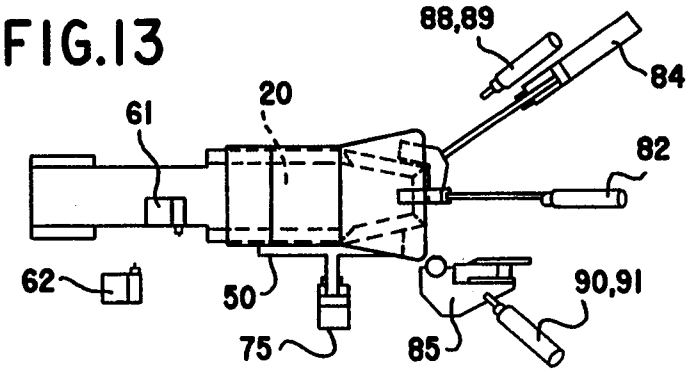
Figure 16:
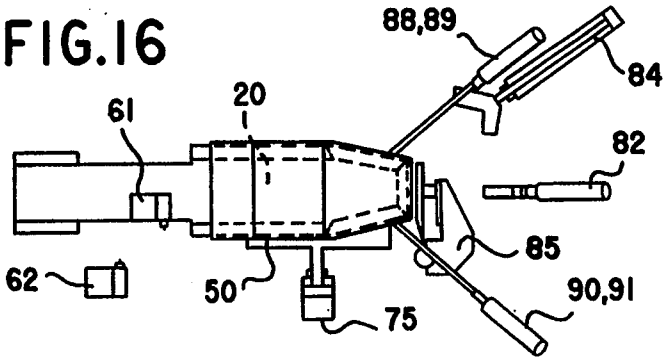

FIGS. 10, 13 and 16 are partial lateral views, perpendicular to FIGS. 8, 11 and 14, corresponding respectively to FIGS. 9, 12 and 15.

FIG. 17 is a view, flat, of another embodiment of a blank .according to the invention.

Figure 18:
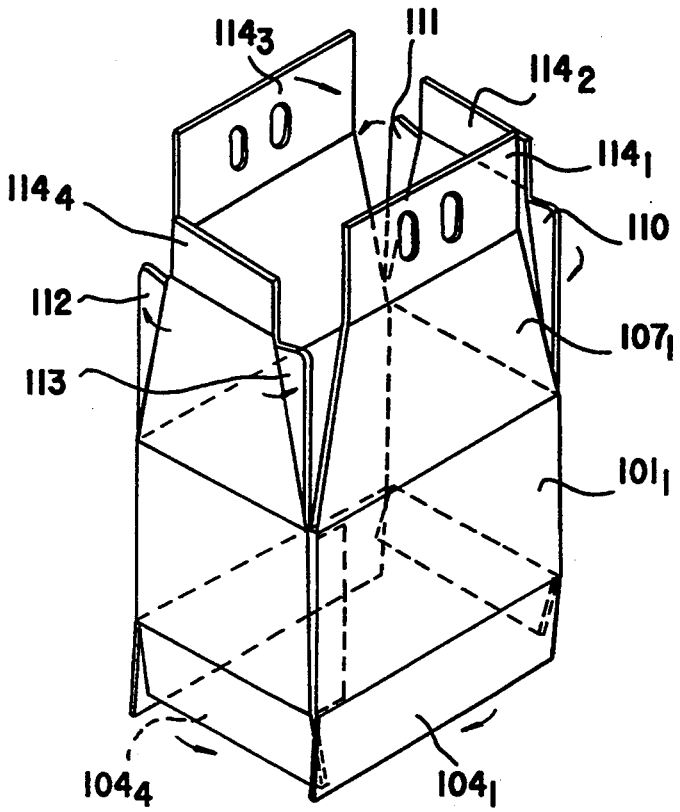

FIG. 18 is a view, in perspective, of the box during formation, formed from the blank of FIG. 17.

FIG. 19 is a view, in perspective, of the box once finished, formed from the blank of FIG. 17.

Figure 20:
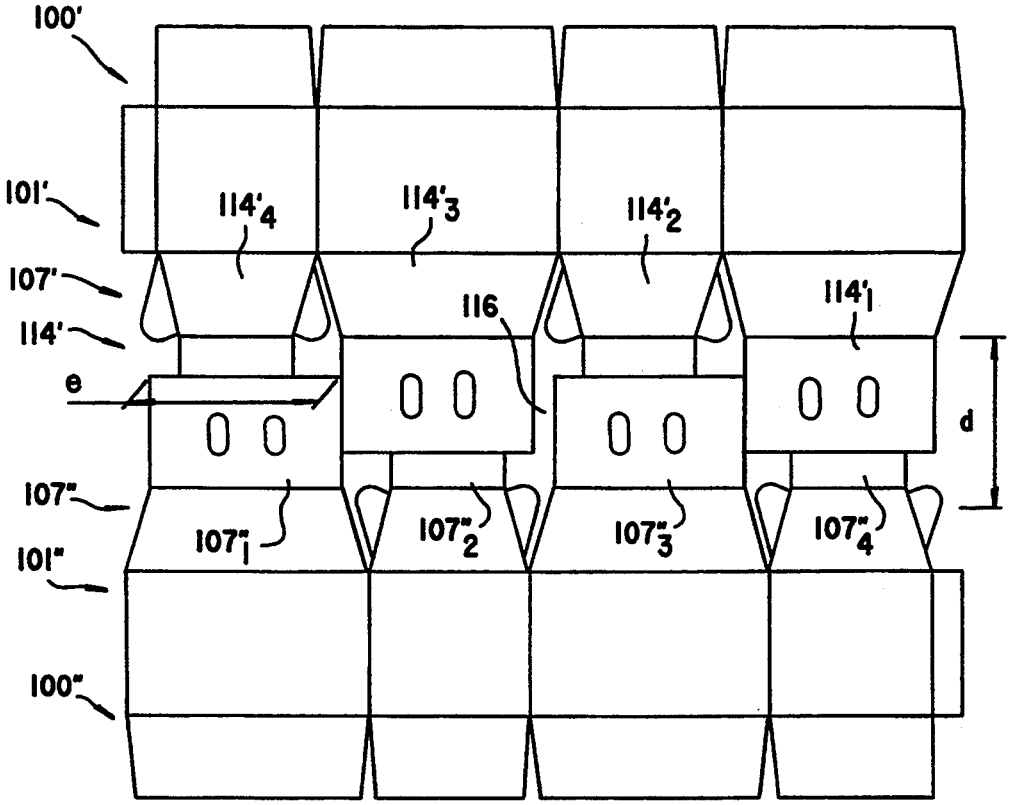

FIG. 20 illustrates diagrammatically the head-to-head fitting of two blanks according to the embodiment of FIG. 17 permitting an optimised cut-out.

FIG. 21 is a view, flat, of another embodiment of a blank according to the invention for a box having a substantially parallelepipedal lower part with cut corners.

Figure 22:
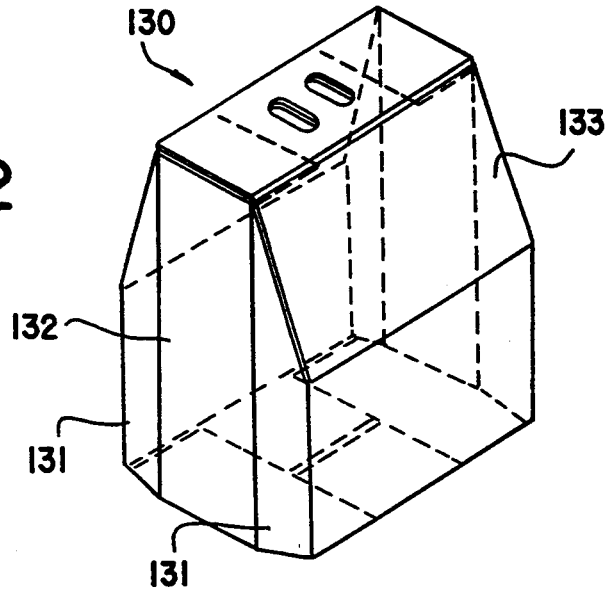

FIG. 22 is a view, in perspective, of the box formed from the blank of FIG. 21.

Figure 23:
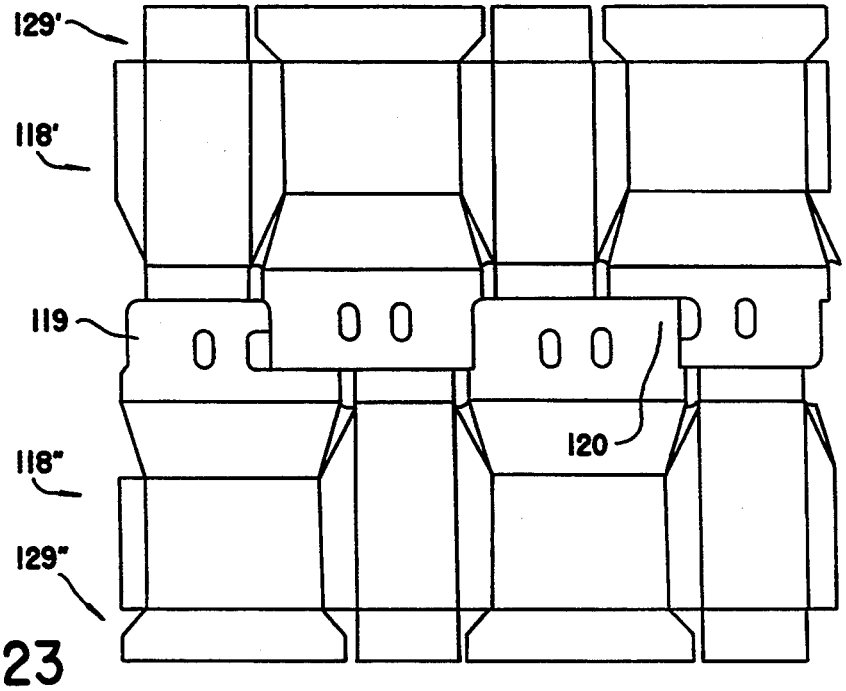

FIG. 23 illustrates the head-to-tail fitting of two blanks according to the embodiment of FIG. 21.

The blank F of sheet material, for example cardboard or corrugated cardboard, shown by FIG. 1, includes a series of four aligned rectangular panels 1 to 4, in pairs, which are connected by preformed parallel folding lines 5 to 7. Along the free edge of the outermost panel 4 of said series of panels is arranged a tongue 8 connected to said outermost panel 4 by a folding line 9 parallel to the folding lines 5 to 7.

Moreover, rectangular flaps 10.1, 10.2, 10.3, 10.4 are respectively provided on one side of each panel 1, 2, 3 and 4. Each lateral flap, 10.1, 10.2, 10.3, 10.4 is hinged to the corresponding panel 1, 2, 3 or 4 by a preformed folding line 11.1, 11.2, 11.3 or 11.4 [sic]. These folding lines 11.1, 11.2, 11.3 and 11.4 are aligned and perpendicular to the folding lines 5 to 7 and 9. Moreover, a trapezoidal panel 12.1, 12.2, 12.3 and 12.4 is associated with each panel 1 to 4 on the side opposite the flaps 10.1 to 10.4. Each panel 12.1, 12.2, 12.3 and 12.4 is hinged to the corresponding panel 1, 2, 3, 4 by a preformed folding line 13.1, 13.2, 13.3 or 13.4, corresponding to its large base. The folding lines 13.1, 13.2, 13.3 and 13.4 are aligned and perpendicular to the folding lines 5 to 7 and 9.

The rectangular panels 1 to 4 and the tongue 8 all have the same height h. The two panels 1 and 3 are identical to each other and have a length L. The two panels 2 and 4 are identical to each other and have a length l, less than L.

Furthermore, a rectangular flap 14.1, 14.2, 14.3 or 14.4 is associated with each trapezoidal panel 12.1 to 12.4 on the side opposite the panels 1 to 4. Each flap 14.1 to 14.4 is hinged to the corresponding panel 12.1 to 12.4 by a preformed folding line 15.1, 15.2, 15.3 or 15.4, corresponding to the small base of said panels 12.1 to 12.4.

The folding lines 15.1 to 15.4 are aligned and perpendicular to the folding lines 5 to 7 and 9.

Finally, along the two inclined edges of each of the panels 12.1 and 12.4, triangular tongues 16 are hinged along preformed folding lines 17. The triangular tongues 16 of the panel 12.2 are respectively housed between the latter and the panels 12.1 and 12.3, whereas a triangular tongue 16 of the panel 12.4 is housed between the latter and the panel 12.3. The other triangular tongue 16 of the panel 12.4 projects outward, on the side of the tongue 8.

The blank F is intended to form, by wrapping and fastening of the panels 1 to 4 and fastening of the panels 12.1 to 12.4 and of the flaps 10.1, 10.2, 10.3, 10.4, 14.1, 14.2, 14.3 and 14.4 in the manner described hereinabove in more detail with regard to FIGS. 6 to 16—the box C shown in FIG. 3. The box C has the general appearance of a parallelepiped pa on which a pyramid py is mounted. In the box C, the large lateral faces of the parallelepiped pa are formed by the panels 1 and 3, whereas the small lateral faces of the latter are formed by the panels 2 and 4, the panels 12.1, 12.3 and 12.2, 12.4 respectively forming the large faces and the small faces of the pyramid py. In addition, the bottom of the box C is made up by the flaps 10.1, 10.2, 10.3 and 10.4, whereas the lid of said box C is made up by the flaps 14.1, 14.2, 14.3 and 14.4. The tongues 16 are folded over against the large faces of the pyramid py and are fixed thereto, preferably by gluing, in order to seal along the lateral intersecting edges of said pyramid.

The flaps 10.1 and 10.3 are identical and rectangular. They have a length equal to the length L of the panels 1 and 3. The flaps 10.2 and 10.4 are identical to each other. They have a length equal to the length l of the panels 2 and 4.

The box C is represented in FIG. 2 with its pyramid open, so as to show the relative arrangements of the panels 12.1 to 12.4, the flaps 14.1 to 14.4 and the tongues 16. However, as will emerge hereinbelow, the arrangement of FIG. 2 does not occur during the manufacturing procedure described hereinbelow, the box being automatically closed off on the side of its pyramid.

FIG. 4 illustrates, in vertical section, one application of the box C for the packaging of bottles B separated by a separating crosspiece S. It may be seen that, by virtue of the pyramidal part py of the box C, corresponding to the panels 12.1 to 12.4, the upper part of the bottles B is espoused by the box C. The empty projecting corners 18 (in dotted lines) are eliminated and replaced by inclined walls relatively invulnerable to external attack. In addition, at each corner, compared to a known rectangular box, it may be seen that less sheet material is used, it being possible to save up to approximately 30% for each upper corner.

FIGS. 8 to 16 illustrate diagrammatically a machine making it possible to manufacture the box C with the pyramidal part py closed by the flaps 14.1 to 14.4, but the bottom (formed by the flaps 10.1 to 10.4) open. These figures, for reasons of clarity, are intentionally partial and simplified and they each include only the elements necessary for understanding the manufacturing phases which they illustrate.

The machine of FIGS. 8 to 16 comprises a mandrel 20 (shown on a larger scale in FIG. 5), the outer shape of which corresponds to the inner shape of the box C to be obtained from the blank F. For this purpose, the mandrel 20 comprises a parallelepipedal part 21 extended by a pyramidal part 22. As shown in FIGS. 8 to 16, the length of the parallelepipedal part 21 of the mandrel 20 may be different from the height h of the lateral panels of the box C. The mandrel 20 can be solid or only made up of a frame delimiting its intersecting edges, as is shown in said FIGS. 6 and 7. In these figures, it is assumed that said mandrel 20 was made up of sectional profiles 23 (seen in section in FIGS. 6*a* to 6*c* and in front view in FIGS. 7*a* to 7*c*) defining rectangular lateral bearing faces 24 to 27 for the panels 1 to 4 of the blank F, folding intersecting edges 28 to 31 corresponding to the folding lines 5 to 9, trapezoidal bearing faces 32 to 35 for the panels 12.1 to 12.4, junction intersecting edges 36 to 39 for the latter and a front bearing face 40 for the flaps 14.1 to 14.4, the contour of said front bearing face 40 forming folding intersecting edges corresponding to the folding lines 15.1 to 15.4 of said flaps 14.1 to 14.4.

FIGS. 6*a*, 6*b*, 6*c* and 7*a*, 7*b*, 7*c* illustrate diagrammatically the procedure for positioning the blank F with respect to the mandrel 20, when it is desired to apply the intermediate panel 3 against the corresponding lower face 24 of the mandrel 20.

By known means, for example those shown in document FR-A-2,629,012, a blank F is brought into the vicinity of the mandrel 20, so that its panel 3 is arranged, at least approximately, opposite the bearing face 24. Although the lateral positioning and the longitudinal positioning of said panel 3 with respect to said face 25 are desired to be as accurate as possible, it may turn out that a lateral offset d1 and a longitudinal offset d2 appear between the panel 3 and the bearing faces 24 and 32 (see FIGS. 6*a* and 7*a*). In order to prevent inopportune folding of the blank F, on the outside of the folding lines 6, 7 and 13.3, while the other panels of the blank F are folded over, before said other panels are folded over, the panel 3 is made to move away from the bearing face 24 (see FIGS. 6*a* and 7*a*). Next, while said panels 2.1 on the one hand, and the panel 4 and the tongue 8 on the other hand, are being folded over, the panel 3 is moved closer to the bearing face 24 by means of a pressure plate 50 (see FIG. 5), the profile of which is concave and which, longitudinally with respect to the mandrel 20, has a face 51 which can be superposed on the rectangular face 24 of said mandrel and a face 52 which can be superposed on the trapezoidal face 32 of the mandrel 20, the faces 51 and 52 being connected together by an intersecting edge 53 which can be superposed with the intersecting edge 41 connecting said faces 24 and 32 of said mandrel 20. Thus, while the panel 3 moves closer to the face 24 (arrow P), the panels 2,1 on the one hand, and the panel 4 and the tongue 8 on the other hand, are in bearing contact against the mandrel 20 (see FIG. 6b), which generates a lateral guiding effect and precisely positions the panel 3 laterally with respect to the bearing face 24 (see FIG. 6*c*). Simultaneously, the trapezoidal faces 32 and 52 exert a pressure on the panel 12.3, folding it around the folding line 13.3 connecting it to the panel 3 and causing the blank F to slide longitudinally so that this folding line comes vertically in line with the intersecting edge 41 (see FIG. 7*b*). When the plate 50 presses the panel 3 between the bearing face 24, (see FIGS. 6*c* and 7*c*), the folding lines 6, 7 and 13.3 are exactly and respectively superposed on the intersecting edges 28, 31 and 41 of the mandrel 20.

Since the blank F is then temporarily rendered integral with the mandrel 20 by the pressure exerted by the plate 50, the formation of the box C can then be continued by wrapping the panels 1, 2, 4 and the tongue 8 around the parallelepipedal part 21 of said mandrel and folding the panels 12.1, 12.2 and 12.4 over against the trapezoidal faces of the pyramidal part 22 of the latter.

By virtue of such wrapping and of such folding-over, the panels 1, 2, 4, 12.1, 12.2 and 12.4 are respectively applied against the faces 26, 25, 27, 34, 33 and 35, the tongue 8 being folded over onto the face 26 (before or after the panel 1). It is therefore possible to fasten respectively, for example by gluing, the tongue 8 and the panel 1, and between them the panels 12.1 to 12.4, by virtue of the triangular tongues 16.

Next, the flaps 14.1 to 14.4 are folded over around the intersecting edges of the front face 40 of the mandrel 20 corresponding respectively to the folding lines 15.1 to 15.4, in order to be applied against said front face 40, and they are then fastened to each other, for example by gluing. The box C shown in FIG. 3 is then obtained, which is fitted over the mandrel 20 and open on the side of the flaps 10.1 to 10.4.

In order to fill this box C, it is disengaged from the mandrel 20 and filled through its open bottom made up by fastened flaps 10.1 to 10.4. After filling, the box C can be closed by folding said flaps 10.1 to 10.4, respectively around the folding lines 11.1 to 11.4 and, finally, by fastening said flaps 10.1 to 10.4, for example by gluing. The closed box C shown by FIG. 3 is then obtained.

The operations indicated hereinabove may be carried out automatically by virtue of the machine illustrated diagrammatically and partially in FIGS. 8 to 16. This machine includes a stand 60 with respect to which the mandrel 20 and the pressure plate 50 are mounted. In addition, it includes a device (not shown) of any known type, enabling blanks F to be taken up one by one from a magazine in order to bring them beneath the mandrel 20. Glue applicators 61 to 67, mounted on the stand 60, enable lines of adhesive 68 to 74 to be deposited, respectively on the tongue 8, on the tongues 16 and on the flaps 14.2 and 14.4, while a blank F is being brought beneath the mandrel 20.

Thus, by virtue of the glue applicators 61 to 67, the blank F is arranged, already glued, beneath the mandrel 20 in the position shown in FIGS. *6a* and *7a*, above the pressure plate 50, driven by a cylinder actuator 75 carried by the stand 60.

In order to wrap the panels 1 to 4 and the tongue 8 around the parallelepipedal part 21 of the mandrel 20, the machine includes a mechanism including movable equipment 76 which can be raised or lowered by means of a cylinder actuator 77 bearing on the stand 60.

The movable equipment 76 includes two hinged arms 78 and 79, for example respectively driven by a linkage 80 connected to the stand 60 and by a cam 81 mounted on said stand.

Actuators 82 to 84, such as cylinder actuators for example, are mounted on the stand 60 and can fold over the panels 12.4, 12.2 and 12.1 and the flaps 14.4, 14.2 and 14.1 respectively. Another actuator 85 can fold over the flap 14.3. Pressers 86 and 87, also mounted on the stand 60, are provided in order to apply the tongue 86 and the panel 1 against the face 26 of the mandrel 20. Other pressers 88 to 91 (mounted on the stand 60) are provided in order to fold over the tongues 16 against the mandrel 20.

Having brought a blank F beneath the mandrel 20 so as to lie in the position of FIGS. *6a* and *7a* (see FIGS. 8 and 9), the cylinder actuators 75 and 77 are actuated so that, on the one hand, the pressure plate 50 is moved closer to the mandrel 20 and so that, on the other hand, the hinged arms 78 and 79, in response to the rise of the movable equipment 76, fold the panels 1, 2 and 4 of the blank F, respectively arranged on either side of the panel 3. The blank F then successively assumes, with respect to the mandrel 20, the relative positions illustrated by FIGS. *6a*, *6b*, *6c* and *7a*, *7b*, *7c*. Next, with the movable equipment 76 continuing to rise, the arms 78 and 79 press the panels 1, 2, 4 respectively against the corresponding faces of the mandrel 20 (see FIG. 11).

The actuators 82 to 84 fold over the panels 12.2, 12.1 and 12.4 and the flaps 14.2, 14.1 and 14.4 (FIGS. 12 and 13), the presser 86 applies the tongue 8 against the face 26 of the mandrel (FIG. 11), after which the other presser 87 applies the panel 1 against the tongue 8 and the face 26 (FIG. 14). By virtue of the lines of adhesive 68, 73 and 74, the panel 1 is therefore fastened to the tongue 8 and the flaps 14.1, 14.2 and 14.4 are fastened to each other (see FIGS. 12 and 13).

Next, the actuators 85 and 88 to 91 fold over the flap 14.3 and the tongues 16, respectively against the front face 40 and the faces 32 and 34 of the mandrel 20 (FIGS. 15 and 16). By virtue of the lines of adhesive 69 to 72, 73 and 74, the tongues 16 are fastened to the panels 12.1 and 12.3 and the flap 14.3 is fastened to the flaps 14.1, 14.2 and 14.4.

FIG. 17 shows a blank 100 according to another embodiment of the invention, flat, including a set 101 of first panels, namely two rectangular first panels $\mathbf{101}_1$ and $\mathbf{101}_3$ and two square first panels $\mathbf{101}_2$ and $\mathbf{101}_4$, the size of these panels depending in fact on the size of the bottles or other products capable of being packed in the box obtained from this blank.

Each panel is connected to one or two adjacent panels by mutually parallel first folding lines $\mathbf{102}_1$, $\mathbf{102}_2$ and $\mathbf{102}_3$.

A tongue 103 for fixing the panel $\mathbf{101}_1$ to the panel $\mathbf{101}_4$ is provided, for example by gluing.

Four lower flaps $\mathbf{104}_1$, $\mathbf{104}_2$, $\mathbf{104}_3$ and $\mathbf{104}_4$ suitable for forming the bottom 104 of the box 105 (see FIG. 19) are provided and connected respectively, at the bottom part of the four first panels, by second folding lines $\mathbf{106}_1$, $\mathbf{106}_2$, $\mathbf{106}_3$ and $\mathbf{106}_4$.

In addition, the blank 100 includes a set 107 of second panels, namely two second panels $\mathbf{107}_1$ and $\mathbf{107}_3$ having free lateral edges $\mathbf{108}_1$, $\mathbf{108}_2$, $\mathbf{108}_3$ and $\mathbf{108}_4$, said panels having an isosceles trapezoidal shape, the large base of which is connected, at the top part, respectively to the first panels $\mathbf{101}_1$ and $\mathbf{101}_3$ by folding lines $\mathbf{109}_1$ and $\mathbf{109}_3$ perpendicular to the first folding lines, and the small base constitutes two upper edges of the folded box, and two second panels $\mathbf{107}_2$ and $\mathbf{107}_4$, the body of which has an isosceles trapezoidal shape having lateral edges $\mathbf{108}_5$, $\mathbf{108}_6$, $\mathbf{108}_7$ and $\mathbf{108}_8$, also free, comprising identical isosceles triangular tabs 110, 111, 112 and 113 having an angle at the apex slightly greater than the angle $\alpha$ formed by the height and the lateral intersecting edge of the isosceles trapezium of said body.

This angle may, for example, lie between of the order of 40° and of the order of 5°, advantageously 20°.

Finally, the blank includes four rectangular upper flaps 114, namely two large upper flaps $\mathbf{114}_1$, $\mathbf{114}_3$, interspersed with two small upper flaps $\mathbf{114}_2$ and $\mathbf{114}_4$ and respectively connected to the upper panels $\mathbf{107}_1$ and $\mathbf{107}_3$ and $\mathbf{107}_2$ and $\mathbf{107}_4$ by fourth folding lines perpendicular to the first folding lines.

The two large upper flaps make up the upper face 114 of the box, which face they occupy substantially over its entire surface.

Each large flap includes two oblong holes 115 which, when the two flaps are folded one over the other, coincide.

FIG. 18 shows the way the box is folded. For reasons of clarity, the mandrel has not been shown.

The box can be folded from the top, after closing the bottom, or advantageously by the bottom after forming and gluing the parallelepipedal lower and trapezoidal upper parts of the box.

The tabs 110 to 113 enable the box to be squared and mounted automatically and at a high rate.

The tabs 110 to 113 are folded inside the second panels $107_1$ and $107_3$, as may be seen by broken lines in FIG. 19 showing the formed box.

FIG. 20 shows the arrangement of two blanks 101' and 101" according to FIG. 17 which permit an optimised cut-out of the blanks, the transverse and longitudinal dimensions of the second panels, and especially of the large flaps $114'_1$, $114'_3$; $114''_1$, $114''_3$ and of the small flaps $114'_2$, $114'_4$; $114''_2$, $114''_4$ being constructed so that the distance d between the third folding line of the two blanks 101' and 101" placed head to head, symmetrically rotated with respect to an axis extending perpendicularly from the blank and including a point 116, is constant, the upper edges 117' and 117" of said respective flaps being in contact.

The width l of the widest flaps depends on the overall dimensions of the package, so that one cut-out of the two blanks 118' and 118" thus arranged is possible (cf., for example, FIG. 23 in this regard), or one of the large upper flaps 119 is, in part, cut out in order to permit making up one upper lateral face with the other large upper flap 120, itself not cut out, and into which it is fitted, the cut-out having a shape complementary to the peripheral lateral edge of the adjacent large flap 120.

FIG. 21 shows a blank 121 according to another embodiment of the invention comprising principal lateral first panels $122_1$, $122_2$, $122_3$ and $122_4$ which are rectangular, and intermediate lateral first panels $123_1$, $123_2$, $123_3$ and $123_4$, said intermediate panels having a rectangular lower part connected to the other first panels by said first folding lines and including a triangular upper part having an upper edge $124_1$, $124_2$, $124_3$ and $124_4$, separated from the rest of the panel by an intersecting edge forming a folding line, said intersecting edge connecting the third folding line (as defined previously) $125_1$, $125_3$ with the fourth folding line $125_2$ and $125_4$.

The edges $124_1$, $124_2$, $124_3$ and $124_4$ comprise triangular tongues or tabs $127_1$, $127_2$, $127_3$ and $127_4$ which are free (even though in contact), with respect to the edges of the adjacent second panels $128_1$ and $128_2$ in the form of an inverted trapezium. The tabs $127_1$ to $127_4$ are constructed for being folded easily and automatically while the box is being formed, especially on account of their small dimensions, the base being slightly incurvate and, for example, of length from 1 to 2 cm for an angle or apex of 3 ° to 10°.

Finally, the blank 12 1 comprises lower flaps $129_1$, $129_2$, $129_3$ and $129_4$ connected by second folding lines respectively to the panels $122_1$, $122_2$, $122_3$ and $122_4$, the flaps $122_3$ and $129_1$ and $129_3$ each having, and on either side, lateral sides, slanting at least in part towards the outside of the flap from said second folding lines.

The lower flaps $129_2$ and $129_4$ are, for their part and for example, of rectangular shape.

When the box 130 (see FIG. 22) obtained with the blank, which has just been described in reference to FIG. 21, is formed, it has cut corners 131, vertical faces 132 from top to bottom of the box and oblique-sided faces 133 formed by the second panels.

We claim:

1. A blank of sheet-type cardboard which is folded to produce a packaging having a bottom, a parallelepiped portion upstanding from the bottom, a truncated pyramid portion upstanding from the parallelepiped portion, and a top, said blank comprising:

a series of four rectangular first panels connected together through first parallel folding lines extending from a top part to a bottom part of said first panels, wherein said first panels form the parallelepiped portion when folded along said first folding lines;

a series of four lower flaps, a respective said lower flap being connected at a respective bottom part of a respective said first panel through a respective second folding line which is perpendicular to said first folding lines, wherein said four lower flaps form the bottom when folded along said second folding lines;

a disconnected series of four second panels having free lateral edges therebetween and at each end of the series so that eight free lateral edges are provided, an upper part and a lower part, wherein (a) a respective said lower part of each respective said second panel is connected to a respective top part of a respective said first panel through a respective third folding line which is perpendicular to said first folding lines, (b) four of the eight free lateral edges of said second panels are formed as a triangular tab connected to a remainder of said second panel by a fourth folding line, (c) all of said free lateral edges of said second panels are separated laterally from any adjacent said free lateral edge by a defined distance, and (d) said second panels form the truncated pyramid portion when folded along said third folding lines and said triangular tabs form a connection between said second panels when folded over along said fourth folding lines and connected to an adjacent said second panel; and a series of four disconnected upper flaps having an upper part and a lower part, a respective lower part of each respective said upper flap being connected to a respective top part of a respective said first panel through a respective fifth folding line which is perpendicular to said first folding lines, two of said upper flaps not adjacent one another having a surface area equal in size to the top of the packaging, wherein said upper flaps form the top when folded along said fifth folding lines.

2. A blank as claimed in claim 1 wherein said four tabs are formed integrally with two of said second panels which are non-adjacent.

3. A blank as claimed in claim 2 wherein said defined distance is 3 mm to 10 mm.

4. A blank as claimed in claim 1 wherein said four tabs are respectively integrally formed with a separate respective said second panel.

5. A blank as claimed in claim 2 wherein there are adjacent pairs of said lateral edges of said second panels with the adjacent pairs of lateral edges being inclined relatively and in alternating directions to said third folding lines, and wherein said fourth folding line of one respective said tab of a respective second panel is parallel to the lateral edge of the other said tab of the respective said second panel.

6. A blank of sheet-type cardboard which is folded to produce a packaging having a bottom, a parallelepiped portion upstanding from the bottom, a truncated pyramid portion upstanding from the parallelepiped portion, and a top, said blank comprising:

a series of four rectangular first panels connected together through first parallel folding lines extending from a top part to a bottom part of said first panels, wherein said first panels form the parallelepiped portion when folded along said first folding lines;

a series of four lower flaps, a respective said lower flap being connected at a respective bottom part of a respective said first panel through a respective second folding line which is perpendicular to said first folding lines, wherein said four lower flaps form the bottom when folded along said second folding lines;

a disconnected series of four second panels having free lateral edges therebetween and at each end of the series so that eight free lateral edges are provided, an upper part and a lower part, wherein (a) a respective said lower part of each respective said second panel is connected to a respective top part of a respective said first panel through a respective third folding line which is perpendicular to said first folding lines, (b) four of the eight free lateral edges of said second panels are formed as a triangular tab connected to a remainder of said second panel by a fourth folding line, (c) said tabs form an isosceles triangle with an apex at an intersection of said lateral edge and said fourth folding line, with a respective said apex separated from an adjacent said third folding line by a predetermined distance, and (d) said second panels form the truncated pyramid portion when folded along said third folding lines and said triangular tabs form a connection between said second panels when folded over along said fourth folding lines and connected to an adjacent said second panel; and a series of four disconnected upper flaps having an upper part and a lower part, a respective lower part of each respective said upper flap being connected to a respective top part of a respective said first panel through a respective fifth folding line which is perpendicular to said first folding lines, two of said upper flaps not adjacent one another having a surface area equal in size to the top of the packaging, wherein said upper flaps form the top when folded along said fifth folding lines.

7. A blank as claimed in claim 6 wherein said predetermined distance is between 3 mm and 3 cm.

8. A blank as claimed in claim 6 wherein said four tabs are formed integrally with two of said second panels which are non-adjacent.

9. A blank as claimed in claim 6 wherein said four tabs are respectively integrally formed with a separate respective said second panel.

10. A blank as claimed in claim 8 wherein there are adjacent pairs of said lateral edges of said second panels with the adjacent pairs of lateral edges being inclined relatively and in alternating directions to said third folding lines, and wherein said fourth folding line of one respective said tab of a respective second panel is parallel to the lateral edge of the other said tab of the respective said second panel.

11. A blank of sheet-type cardboard which is folded to produce a packaging having a bottom, a parallelepiped portion upstanding from the bottom, a truncated pyramid portion upstanding from the parallelepiped portion, and a top, said blank comprising:

a series of four rectangular first panels connected together through first parallel folding lines extending from a top part to a bottom part of said first panels, wherein said first panels form the parallelepiped portion when folded along said first folding lines;

a series of four lower flaps, a respective said lower flap being connected at a respective bottom part of a respective said first panel through a respective second folding line which is perpendicular to said first folding lines, wherein said four lower flaps form the bottom when folded along said second folding lines;

a disconnected series of four second panels having free lateral edges therebetween and at each end of the series so that eight free lateral edges are provided, an upper part and a lower part, wherein (a) a respective said lower part of each respective said second panel is connected to a respective top part of a respective said first panel through a respective third folding line which is perpendicular to said first folding lines, (b) four of the eight free lateral edges of said second panels are formed as a triangular tab connected to a remainder of said second panel by a fourth folding line, and (c) said second panels form the truncated pyramid portion when folded along said third folding lines and said triangular tabs form a connection between said second panels when folded over along said fourth folding lines and connected to an adjacent said second panel; and a series of four disconnected upper flaps having an upper part and a lower part, wherein (a) a respective lower part of each respective said upper flap is connected to a respective top part of a respective said first panel through a respective fifth folding line which is perpendicular to said first folding lines, (b) two of said upper flaps not adjacent one another are large flaps having a surface area equal in size to the top of the packaging, (c) said large flaps include two gripping orifices therein, and (d) said upper flaps form the top when folded along said fifth folding lines.

12. A blank as claimed in claim 11 wherein said four tabs are formed integrally with two of said second panels which are non-adjacent.

13. A blank as claimed in claim 11 wherein said four tabs are respectively integrally formed with a separate respective said second panel.

14. A blank as claimed in claim 12 wherein there are adjacent pairs of said lateral edges of said second panels with the adjacent pairs of lateral edges being inclined relatively and in alternating directions to said third folding lines, and wherein said fourth folding line of one respective said tab of a respective second panel is parallel to the lateral edge of the other said tab of the respective said second panel.

15. A blank of sheet-type cardboard which are folded to produce two separate packagings having a bottom, a parallelepiped portion upstanding from the bottom, a truncated pyramid portion upstanding from the parallelepiped portion, and a top, said blank comprising: two blank portions which are subsequently separated, each said blank portion including a series of four rectangular first panels connected together through first parallel folding lines extending from a top part to a bottom part of said first panels, wherein said first panels form the parallelepiped portion when folded along said first folding lines;

a series of four lower flaps, a respective said lower flap being connected at a respective bottom part of a respective said first panel through a respective second folding line which is perpendicular to said first folding lines, wherein said four lower flaps form the bottom when folded along said second folding lines;

a disconnected series of four second panels having free lateral edges therebetween and at each end of the series so that eight free lateral edges are provided, an upper part and a lower part, wherein (a) a respective said lower part of each respective said second panel is connected to a respective top part of a respective said first panel through a respective third folding line which is perpendicular to said first folding lines, (b) four of the eight free lateral edges of said second panels are formed as a triangular tab connected to a remainder of said second panel by a fourth folding line, and (c) said second panels form the truncated pyramid portion when folded along said third folding lines and said triangular tabs form a connection between said second panels when folded over along said fourth folding lines and connected to an adjacent said second panel;

a series of four disconnected upper flaps having an upper part and a lower part, wherein (a) a respective lower part of each respective said upper flap is connected to a respective top part of a respective said first panel through a respective fifth folding line which is perpendicular to said first folding lines, (b) two of said upper flaps not adjacent one another are large flaps having a height and a surface area equal in size to the top of the packaging and the other two said upper flaps are small flaps smaller in height and in surface area than said large flaps, and (c) said upper flaps form the top when folded along said fifth folding lines; and wherein said two blank portions are disposed as if rotated about an axis perpendicular to a plane of the blank with respective said large flaps of each of said blank portions head to head with respective said small flaps of the other said blank portions.

16. A blank as claimed in claim 15 wherein said four tabs of each said blank portion are formed integrally with two of said second panels which are non-adjacent.

17. A blank as claimed in claim 15 wherein said four tabs of each said blank portion are respectively integrally formed with a separate respective said second panel.

18. A blank as claimed in claim 16 wherein in each said blank portion there are adjacent pairs of said lateral edges of said second panels with the adjacent pairs of lateral edges being inclined relatively and in alternating directions to said third folding lines, and wherein said fourth folding line of one respective said tab of a respective second panel is parallel to the lateral edge of the other said tab of the respective said second panel.

19. A box which is produced from a blank of sheet-type cardboard which is formed by being folded around a mandrel, said box comprising:

an upstanding parallelepiped portion formed by a series of four rectangular first panels connected together at each end of the series by gluing and through first parallel folding lines extending from a top part to a bottom part of said first panels;

a bottom located below said parallelepiped portion formed by a series of four lower flaps, a respective said lower flap being connected at a respective bottom part of a respective said first panel through a respective second folding line which is perpendicular to said first folding lines;

a truncated pyramid portion upstanding from said parallelepiped portion and formed by a series of four second panels connected by gluing and having lateral edges therebetween and at each end of the series so that eight free lateral edges are provided, an upper part and a lower part, wherein a respective said lower part of each respective said second panel is connected to a respective top part of a respective said first panel through a respective third folding line which is perpendicular to said first folding lines; and a top formed at an upstanding end of said pyramid portion by a series of four disconnected upper flaps having an upper part and a lower part, a respective lower part of each respective said upper flap being connected to a respective top part of a respective said first panel through a respective fourth folding line which is perpendicular to said first folding lines, two of said upper flaps not adjacent one another having a surface area equal in size to said top of the packaging.

20. A box as claimed in claim 19 wherein four of the eight lateral edges of said second panels are formed as a triangular tab which are connected to a remainder of said second panel by a fourth folding line, which said tabs are connected to an adjacent said second panel by gluing.

21. A box as claimed in claim 20 wherein said four tabs are formed integrally with two of said second panels which are non-adjacent.

22. A box as claimed in claim 19 wherein said tabs form an isosceles triangle with an apex at an intersection of said lateral edge and said fourth folding line, with a respective said apex separated from an adjacent said third folding line by a predetermined distance.

23. A box as claimed in claim 20 wherein said four tabs are respectively integrally formed with a separate respective said second panel.

24. A box as claimed in claim 19 wherein two of said upper flaps not adjacent one another include gripping orifices therein which overlap.

25. A box as claimed in claim 21 wherein there are adjacent pairs of said lateral edges of said second panels with the adjacent pairs of lateral edges being inclined to form a plane with the associated said third folding lines.

* * * * *